US005090933A

United States Patent [19]

Capek et al.

[11] Patent Number: 5,090,933

[45] Date of Patent: Feb. 25, 1992

[54] PROVISION OF SUPPORT FOR TENSION SHADOW MASK BY WHICH A PREDETERMINED Q-HEIGHT IS ESTABLISHED WITHOUT POST-INSTALLATION MODIFICATION THEREOF

[75] Inventors: Raymond G. Capek, Elmhurst; Siegfried M. Greiner, Crystal Lake, both of Ill.

[73] Assignee: Zenith Electronics Corporation, Glenview, Ill.

[21] Appl. No.: 520,477

[22] Filed: May 8, 1990

[51] Int. Cl.[5] ..... H01J 9/00; H01J 29/07

[52] U.S. Cl. ..... 445/30; 445/68

[58] Field of Search ..... 65/43; 445/25, 30, 45, 445/68

[56] References Cited

U.S. PATENT DOCUMENTS

| | | | |
|---|---|---|---|
| Re. 25,791 | 6/1905 | Claypoole | 65/43 |
| 3,458,926 | 8/1969 | Maissel et al. | 65/43 X |
| 3,960,534 | 6/1976 | Oates | 65/43 |
| 4,728,854 | 3/1988 | Fendley | 313/407 |
| 4,737,681 | 4/1988 | Dietch et al. | 313/407 |
| 4,739,217 | 4/1988 | Fendley et al. | 313/407 X |
| 4,745,330 | 5/1988 | Capek et al. | 313/407 |
| 4,783,614 | 11/1988 | Kraner | 313/407 X |
| 4,790,786 | 12/1988 | Strauss | 445/68 |
| 4,826,463 | 5/1989 | Strauss | 65/43 |
| 4,828,523 | 5/1989 | Fendley et al. | 445/30 |
| 4,891,544 | 1/1990 | Capek et al. | 445/30 |
| 4,891,545 | 1/1990 | Capek et al. | 313/407 |
| 4,891,546 | 1/1990 | Dougherty et al. | 313/401 |
| 4,908,995 | 3/1990 | Dougherty et al. | 51/281 R |
| 5,025,191 | 6/1991 | Fendley | 313/407 |

*Primary Examiner*—Kenneth J. Ramsey

[57] ABSTRACT

A mask support structure is installated as a prefabricated unit in a tension mask color cathode ray tube having a faceplate with a centrally located screening area. The structure has a predetermined Q-height for ultimate affixation on opposed sides of the screening area by means of an inventive fixture and process, which is characterized by Q-height spacers. The structure has a base with a hardened layer of cement of selected thickness thereon for affixing the structure to the faceplate, and on an opposed side, a surface for receiving and securing the mask.

7 Claims, 3 Drawing Sheets

PROVISION OF SUPPORT FOR TENSION SHADOW MASK BY WHICH A PREDETERMINED Q-HEIGHT IS ESTABLISHED WITHOUT POST-INSTALLATION MODIFICATION THEREOF

CROSS-REFERENCE TO RELATED APPLICATIONS

This application is related to but in no way dependent upon copending applications Ser. No. 269,822 filed Nov. 10, 1989, now U.S. Pat. No. 4,891,546; Ser. No. 427,149 filed Oct. 24, 1989; Ser. No. 454,223 filed Dec. 21, 1989, now U.S. Pat. No. 5,025,191; and Ser. No. 458,129 filed Dec. 28, 1989, of common ownership herewith.

BACKGROUND OF THE INVENTION

This invention relates to color cathode ray picture tubes, and is addressed specifically to the manufacture of tubes having shadow masks of the tension foil type in association with a substantially flat faceplate. The invention is useful in the manufacture of color tubes of various types, including those used in home entertainment television receivers, and in medium-resolution and high-resolution tubes intended for color monitors.

The tension foil shadow mask is part of the cathode ray tube front assembly, and is located in close adjacency to the faceplate. As used herein, the term "shadow mask" means an apertured metallic foil which may, by way of example, be about 0.001 inch thick, or less. The mask is supported in high tension a predetermined distance from the inner surface of the faceplate; this dimension is known as the "Q-height." As is well known in the art, the shadow mask acts as a color-selection electrode, or "parallax barrier," which ensures that each of the three beams generated by the electron gun located in the neck of the tube lands only on its assigned phosphor deposits.

PRIOR ART

U.S. Pat. Nos. 4,908,995; 4,828,523; 4,790,786; 4,745,330; and 4,737,681, all of common ownership herewith.

OBJECTS OF THE INVENTION

It is a general object of the invention to provide means and process for use in the manufacture of tension mask color cathode ray tubes that simplify production and reduce production costs.

It is an object of the invention to provide a prefabricated mask support assembly and associated method for supporting a foil tension mask that produces a predetermined mask Q-height without a need for post-installation adjustment of the Q-height.

It is a further object of the invention to provide an apparatus for installing a prefabricated mask support assembly to produce a predetermined mask Q-height.

It is another object of the invention to provide a process by which a support assembly for a foil mask that can be installed either before or after a phosphor screen has been deposited on the faceplate.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
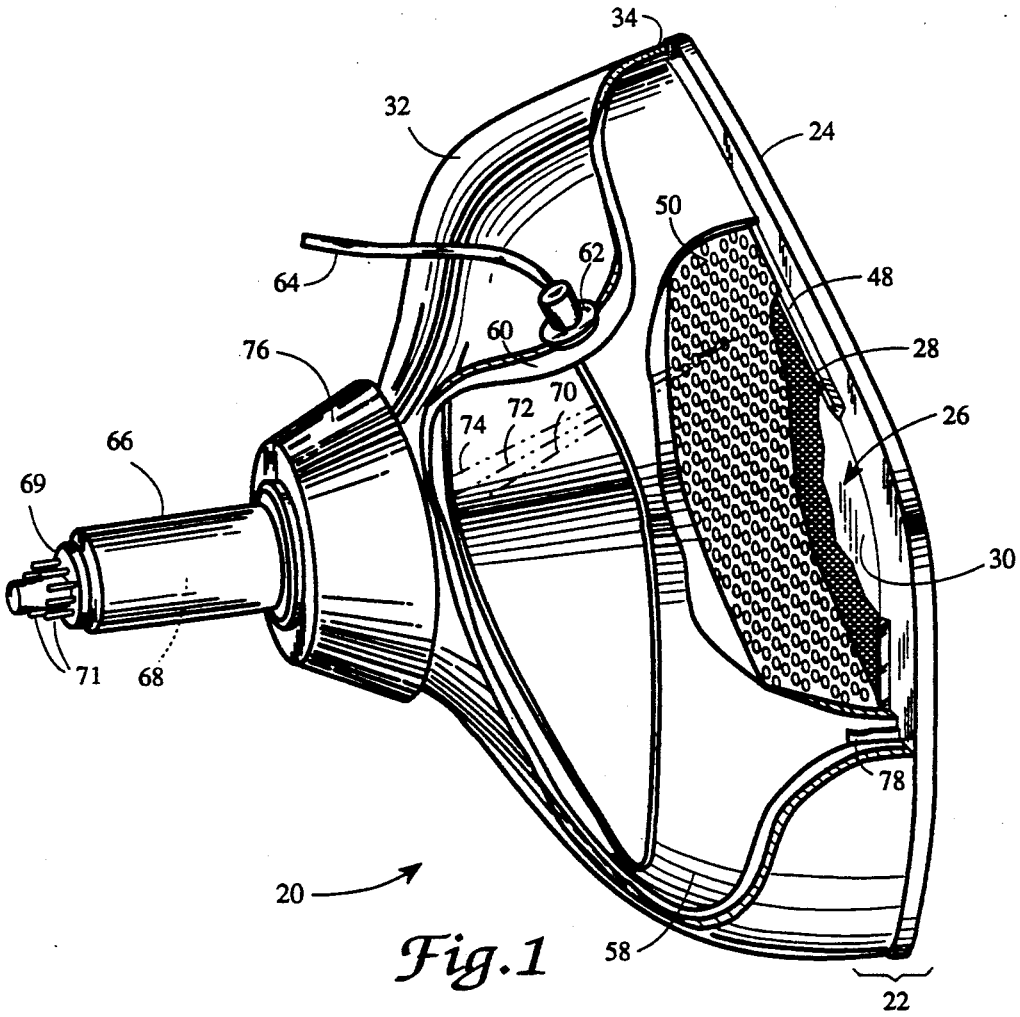
FIG. 1 is a side view in perspective of a tension mask color cathode ray tube having a prefabricated mask support structure subject to the means and process according to the invention, with cutaway sections that indicated the location and relationship of the major components of the tube.
Figure 2:
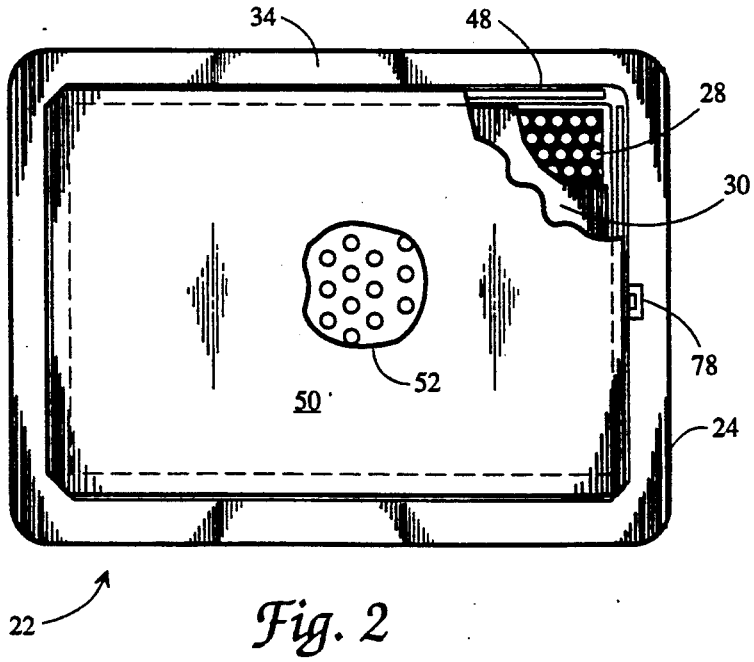
FIG. 2 is a plan view of the front assembly of a flat tension mask color cathode ray tube depicted in FIG. 1, with parts cut away to show the relationship of the faceplate with the mask support structure and shadow mask; insets show mask apertures and phosphor screen patterns greatly enlarged.

A color cathode ray tube having a tension mask support structure according to the invention is depicted in FIGS. 1 and 2. The tube and its component parts are identified in the figures, and described in the following paragraphs in this sequence: reference number, a reference name, and a brief description of structure, interconnections, relationship, functions, operation, and/or result, as appropriate.

20: color cathode ray tube
22: front assembly
24: glass faceplate
26: inner surface of faceplate
28: centrally located phosphor screen on inner surface 26 of faceplate 24; the round deposits of phosphor, shown as surrounded by the black matrix, are depicted greatly enlarged; the screen is also referred to as "the screening area"
30: film of aluminum
32: funnel
34: peripheral sealing area of faceplate 247, adapted to mate with the peripheral sealing area of the mouth of funnel 32
48: mask support assembly according to the invention producing a predetermined Q-height for affixation on opposed sides of screening area 28 for receiving and securing a tensed foil shadow mask; in one embodiment the assembly includes a structure which is "and unitary" can be installed as a prefabricated unit in a foil tension mask cathode ray tube. The mask-receiving surface is preground to provide a planar surface 50: metal foil shadow mask;

after being tensed, the mask is mounted on mask suport structure 48 and secured thereto

52: shadow mask apertures, indicated as greatly enlarged in the inset for illustrative purposes; there is one aperture for every triad of phosphor deposits

58: magnetic shield, internal (a shield, not shown, may also be installed external to the tube envelope)

60: internal conductive coating on funnel

62: anode button

64: high-voltage conductor

66: neck of tube

68: in-line electron gun providing three discrete in-line electron beams 70, 72 and 74 for exciting respective red-light-emitting, green-light-emitting and blue-light-emitting phosphor deposits on screen 28

69: base of tube

71: metal pins for conducting operating voltages through the base of the tube 69 to the electron gun 68

76: yoke which provides for the traverse of beams 70, 72 and 74 across screen 28

78: contact spring which provides an electrical path between the funnel coating 60 and the mask support structure 48.

Figure 3:
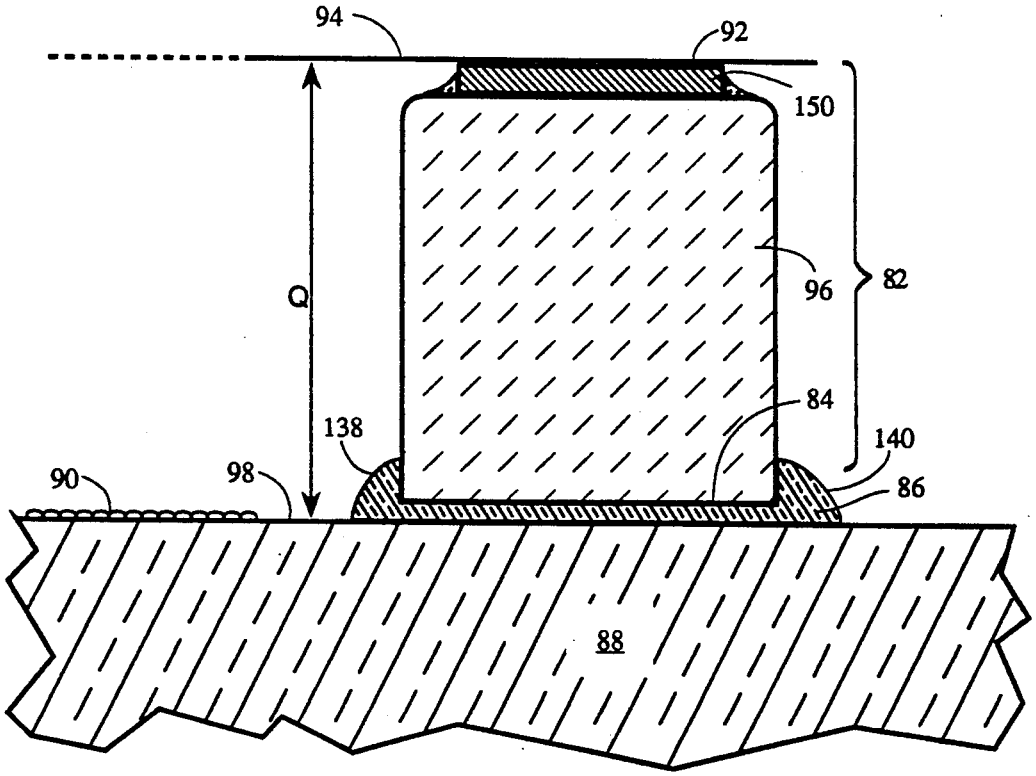
FIG. 3 is a cross-sectional detail view in elevation of a shadow mask support assembly according to the invention.
Figure 3A:
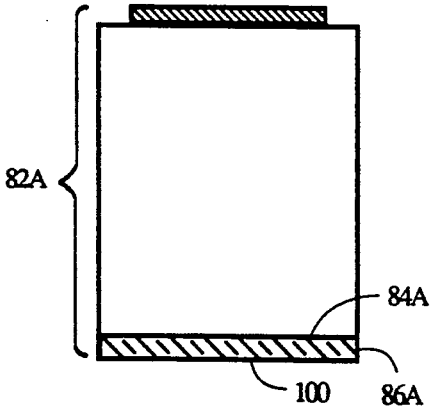
FIG. 3A is similar to FIG. 3 provided to simplify the explanation of the inventive concept.
Figure 4:
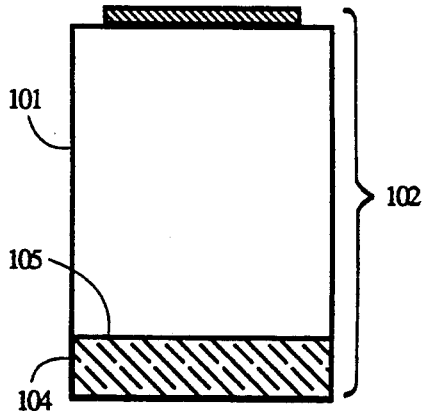
FIG. 4 is similar to FIG. 3 and shows a further configuration of the mask support assembly according to the invention.

As used herein, the following terminology applies: "Mask support structure" ( or "support structure" or "structure") means the main member or "body", designated 96 in FIG. 3, which supports the shadow mask 94. In the illustrated embodiments, the mask support structure also includes a metal strip (newly designated 150) having an upper surface 92 to which a shadow mask 94 is secured. "Cement layer" means a layer, e.g., of solder glass, which is used to secure the mask support structure to the faceplate 88. See "86" in FIG. 3, "86A" in FIG. 3A and "104" in FIG. 4. The cement layer may be secured to the mask support structure before junction with the faceplate as shown in FIGS. 3A and 4, or may be as it appears in FIG. 3 after union with faceplate. "Mask support assembly" or "support assembly" or "assembly" means the combination of a mask support structure and a cement layer.

Figure 5:
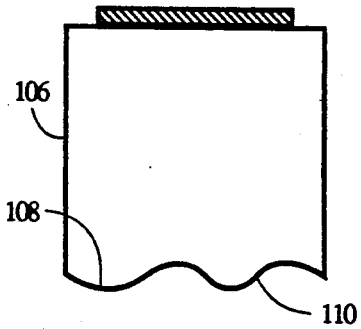
FIG. 5 depicts a mask support structure useful in a process according to the invention.

FIGS. 3A and 4 depict in cross-section embodiments of a foil shadow mask support assembly according to the invention; FIG. 5 depicts a prior art foil mask support structure which can also be installed by the means and process according to the invention. Support structure 82 of FIG. 3 is depicted as having a base 84 with a layer of cement 86, indicated, by way of example, as comprising solder glass. (The thickness indicated is exaggerated for illustrative purposes.) The hardened layer of cement 86 provides for affixing support assembly 82 to a faceplate 88 on opposed sides of a centrally located screening area 90. (Refer to FIGS. 1 and 2 for the relationship of a screening area 28 with a support assembly 48.) On the opposed side of support assembly 82, that is, the side opposite to the base 84, there is indicated a surface 92 on metal strip 150 for receiving and securing a foil shadow mask 94.

The body 96 of support assembly 82 indicated symbolically as comprising a ceramic; the layer of cement 86 is indicated as comprising glass; and the surface 92 for receiving and securing thwe mask is indicated as comprising the surface of a metal strip 150 secured to the body 96.

Support structure 82 produces a predetermined Q-height "Q", indicated by the arrow extending between the inner surface 98 of faceplate 88 and shadow mask 94.

Three assemblies or structures, each having a different height in its uninstalled form, can be installed by the process according to the invention to produce a predetermined Q-height. FIG 3A discloses a mask support assembly 82A. Assembly 82A represents the assembly 82 shown by FIG. 3 before its ultimate affixation on opposed sides of the screening area of a faceplate. The hardened layer 86A of cement, indicated symbolically as comprising glass, may comprise solder glass that is solidified and pre-shrunk but not devitrified. Solidifying the solder glass is accomplished by heating solder glass paste to a temperature of about 410 degrees C. A higher temperature, such as about 440 degrees C., results in devitrification of the solder glass and is to be avoided in this stage of the process of the invention.

In effect, the layer 86A of solder glass cement is pre-shrunk by the application of heat which results in shrinkage of about 50 percent, but without devitrification, after which it is preformed to provide the desired height, preferably by grinding.

Surface 100 of hardened layer 86A is preformed by grinding to ensure a support assembly with flat and parallel surfaces. An additional bead of solder glass paste is added to this layer to compensate for compaction (densification) and fillet formation for the support assembly and faceplate interface.

The hardened layer 86A of cement may also be preformed to provide a mask support assembly having a pre-installation height greater than a predetermined Q-height. This configuration is indicated by FIG. 4 wherein assembly 102 is indicated as having a hardened layer 104 of solder glass affixed to base 105 of body 101. The thickness of the hardened layer of solder glass makes the height of support assembly 102 greater than the desired Q-height.

The "pre-shrinking," that is, the application of solder glass to the base of a support structure body which is cited as being a ceramic, is accomplished as follows. A layer of solder glass paste is first applied to the base of the body, using a solder glass paste application machine such as the type described in conneciton with FIG. 7 of U.S. Pat. No. 4,891,545, of common ownership herewith. The thickness of the solder glass paste, which can be applied to a precise thickness by means of the machine, is preferably about 0.100 inch. The support structure is heated to a temperature of about 410 degrees C., which melts and hardens the solder glass, but does not cause it to devitrify. As a result of heating, the solder glass shrinks to a thickness of about 0.050 inch. The solder glass is then ground flat to a thickness of about 0.030 inch, using a Blanchard-type grinding machine. When the assembly is installed by the means and process of the invention, the thickness of the solder glass layer between the base of the structure and the faceplate is about 0.005 inch. The excess solder glass, represented by the difference between 0.030 inch and 0.005 inch, appears in the form of fillets, such as the fillets 138 and 140 depicted in FIG. 3. The final height "Q" of the support assembly, which is the desired Q-height, is 0.291 inch for a flat tension mask tube having a diagonal measure of 14 inches. The width of the assembly is about 0.220 inch for a 14-inch tube.

FIG. 5 shows a support structure 106 which has no hardened layer of cement on its base, and which has a height less than predetermined Q-height "Q". The base 108 of structure 106 is depicted as being unground or otherwise treated, as indicated by the unsmooth surface 110 (exaggerated). This structure is depicted to point out that most support assemblies and structures of the types shown in this disclosure can be installed to produce a predetermined Q-height by the apparatus and process according to the invention. Such structures includes those disclosed in U.S. Pat. Nos. 4,745,330; 4,739,217; 4,783,614; 4,728,854; 4,891,545 and 4,891,546, all of common ownership herewith.

Figure 6:
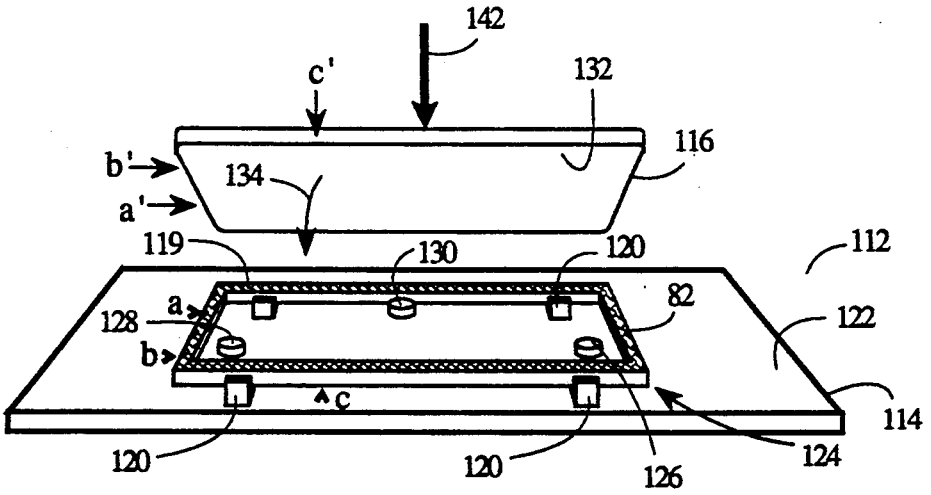
FIG. 6 is a simplified frontal view in perspective of an apparatus according to the invention for installing the inventive support assembly or structure to produce a predetermined Q-height.

The apparatus depicted in FIG. 6 provides for installing, according to the invention, a support assembly or structure on a faceplate such that the mask-receiving surface of the assembly is located at a predetermined Q-height relative to the inner surface of the faceplate. Apparatus 112 comprises fixture means 114 for supporting a faceplate 116 and a mask support assembly 82 in their ultimate operative relative positions. Support assembly 82, which is the assembly depicted in FIG. 3 for purposes of of example, is shown as being nested in a plurality of mask support cradles 120 located on the table area 122 of fixture 114; cradles 120 provide for the precise positioning of support assembly 82 in an inverted position on the table 122 area. A bead of uncured cement 119 is depicted as lying between faceplate 116 and support assembly 82; the bead is indicated as having been applied directly to the base 84 of body 96 of support assembly 82. Q-height spacer means 126, 128 and 130 shown as being three in number, and mounted on table area 122, provide for engaging faceplate 116 to accurately space the inner surface 132 of faceplate 116 from the mask-receiving surface 92 of support assembly 82.

Figure 7:
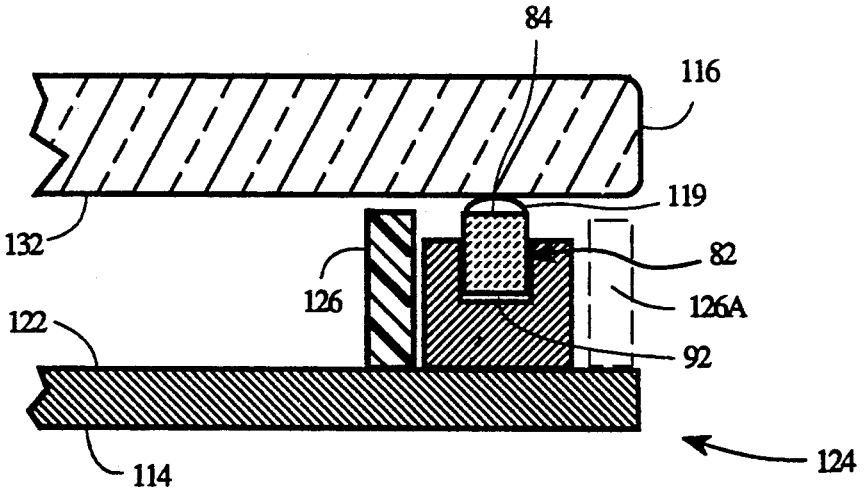
FIG. 7 is a detail view of a section of the apparatus of FIG. 6 depicting details essential to understanding the operation of the apparatus.

Further details of the relationship of the components described are shown in FIG. 7, which is a detail view depicting a representative corner area, indicated by arrow 124 in FIG. 6, of the fixtured assembly.

As faceplate 116 is lowered onto mask support assembly 82 in a traverse indicated arrow 134, it sinks through the bead of uncured cement 119 to a predetermined Q-height as determined by Q-height spacer means 126, 128 and 130, and affixes itself permanently to the mask support assembly 82 when the cement 119 cures. Since the Q-height spacer means must be tolerant of the high heat incident to cathode ray tube manufacture, the material of which the Q-height spacer means are made may comprise carbon, as indicated symbolically.

The table area 122 of fixture 114 is indicated as being tilted for the purpose of registering faceplate 116 with support assembly 82. The "a-b-c" points indicated on fixture 114 provide points of contact with areas a', b', c' on the sides of faceplate 116. The tilt of table area 122 causes faceplate 116, impelled by gravity, to rest against points a-b-c, providing exact registration of the faceplate 116 with the underlying support assembly.

The bead of cement 119 preferably comprises a devitrifying solder glass in paste form. To melt and devitrify the solder glass, apparatus 112 is conveyed on carrier base 136 to a lehr wherein it is subject to a solder-glass-devitrifying temperature of about 440 degrees C. Upon cooling, support assembly 82 is permanently attached to faceplate 116.

With reference again to FIG. 3, the bead of cement 119 is forced from under the layer of hardened cement (solder glass) 86 under the weight of the faceplate 116 to form two fillets 138 and 140, as well as to compensate for further compaction (densification) of layer 86. It may be necessary to add additional weight to the faceplate 116, as indicated by arrow 142. The amount of additional weight is about eight pounds. The additional pressure on the bead of solder glass is necessary to squeeze the solder glass as it melts from between the base 84 of the support assembly 82 and the inner surface 132 of the faceplate 116. The film of solder glass that remains between inner surface 132 and base 84 preferably has a thickness in the range of 0.005 to 0.015 inch. Any greater thickness may affect the integrity of the mask support structure's attachment to the faceplate as solder glass is not considered a structural material, but only an adhesive.

In summary, the apparatus according to the invention may be used to affix a support assembly to a faceplate at a predetermined Q-height under three conditions (1) The support assembly is exactly the predetermined Q-height, as described in connection with FIG. 3A;

(2) The height of the support assembly is greater than a predetermined Q-height, as described in connection with FIG. 4; and, (3) The height of the support structure is less than a predetermined Q-height, as described in connection with FIG. 5.

With regard to condition (2) and with reference to FIG. 4, wherein the height of the support assembly is greater than a predetermined Q-height because of the thickness of the hardened layer of cement, it is not necessary to apply a bead of solder glass to the base, as the quantity of the hardened layer of cement 104, when it melts, is calculated to provide the necessary excess of solder glass to form adequate fillets. As noted, the faceplate can sink only so far into the bead of solder glass, as the depth is controlled by the Q-height spacers according to the invention.

With regard to condition (3) and with reference to FIG. 4: structure 106, the base 110 of which is unground or otherwise untreated, can also be installed to a predetermined Q-height by the apparatus and process according to the invention. It is necessary in this case to add an amount of solder glass paste to base 110 which is adequate enough in volume to squish from beneath the base and form fillets as the faceplate sinks through the bead solder glass paste. In all cases, the volume of cement that comprises the bead must be carefully calculated to prevent overlarge or undersize fillets.

With reference again to FIG. 7, Q-height spacer means 126 is shown as located within the boundary formed by the cradle 120. The Q-height spacer means could as well be located in the peripheral sealing area of the faceplate (please refer to reference No. 34 of FIG. 1). The alternate location is indicated by the dotted outline of Q-height spacer, reference No. 126A, and would be required if a phosphor screen is deposited on the screening area before the mask support the assembly is installed.

The metal strip 150 which provides a surface for receiving and securing the mask, noted as comprising Alloy No. 27, is manufactured by Carpenter Technology of Reading, Pa.; this material has a CTC (coefficient of thermal contraction) of approximately 105 to $109\times10^{-7}$ in/in/degree C. over the range of the temperatures required for devitrification—from ambient temperature to 450 degrees C. Alloys having equivalent characteristics supplied by other manufacturers may as well be used.

The layer of hardened cement 86 may comprise a devitrifying solder glass preformed to provide the support assemblies with a predetermined Q-height. The solder glass, which can be applied in paste form, may comprise by way of example, solder glass No. CV 540T manufactured by Owens-Illinois of Toledo, OH.

The ceramic body 96 of support assembly 82 is indicated as being secured to the glass of faceplate 88 by solder glass layer 86 (104 in FIG. 4) and by fillets 138 and 140 of cement, which comprises an extrusion from the layer of hardened cement 86, noted as comprising solder glass according to the invention. The parameters of the mask support system, including the composition of the solder glass, are preferably effective to place the glass of the faceplate beneath the mask support system into a predetermined degree of tension, as set forth in referent copending application Ser. No. 458,129, of common ownership herewith.

The ceramic component of the support structures is a form of forsterite. A preferred composition comprises:

Talc ($MgO+SiO_2$), 62%
Magnesia (MgO), 28%
Ball Clay, 4%
Barium Carbonate, 6%
Total: 100%

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

We claim:

1. For use in the manufacture of a tension mask color cathode ray tube having a faceplate with an inner surface on which is deposited a centrally located screen, on opposed side of which is a mask support structure cemented to said faceplate by cement means, said mask support structure having a mask-receiving surface, an apparatus for installing said support structure on said faceplate such that said mask-receiving surface is located at a predetermined Q-height relative to said inner surface, the apparatus comprising:

fixture means for supporting said mask-support structure against said faceplate with a layer of cement therebetween; and Q-height spacer means on said fixture means for engaging said faceplate and said mask support structure to accurately space said faceplate inner surface from said mask-receiving surface, wherein said Q-height spacer means comprise three spacers located substantially equidistantly apart whereby said faceplate sinks through cement to a predetermined Q-height relative to said support structure as determined by said Q-height spacer means, and is affixed permanently to said mask-support structure when said cement cures.

2. For use in the manufacture of a tension mask color cathode ray tube having a faceplate with an inner surface on which is deposited a centrally located screen, on opposed sides which is a mask-support structure having a height less than a predetermined Q-height cemented to said faceplate by devitrified solder glass preformed to have a planar surface, and having a mask-receiving surface, an apparatus for installing said support structure on said faceplate such that said mask-receiving surface is located at said predetermined Q-height relative to said inner surface, the apparatus comprising:

fixture means for supporting said mask support structure against said faceplate with a layer of solder glass therebetween; and Q-height spacer means located equidistantly apart on said fixture for engaging said faceplate and said mask-support structure to accurately space said faceplate inner surface from said mask-receiving surface, whereby said faceplate sinks through said solder glass layer to said predetermined Q-height relative to said mask receiving surface of said support structure as determined by said Q-height spacer means, and is affixed permanently to said mask-support structure when said solder glass is heated to a devitrification temperature, and cooled.

3. For use in the manufacture of a tension mask color cathode ray tube having a faceplate, on the inner surface of which is deposited a centrally located screening area, a process for installing a shadow mask support structure on said faceplate on opposed sides of said screening area, comprising:

providing a mask support structure having a height less than a predetermined Q-height and having a base surface for affixation to said faceplate, and on an opposed side, a planar mask-receiving surface;

providing three Q-height spacer means and locating them substantially equidistantly apart;

supporting said support structure against said faceplate with said mask-receiving surface of said mask support structure and said faceplate inner surface spaced apart by a predetermined Q-height;

applying to said base a layer of hardened, preshrunk solder glass; and heating the assemblage to a temperature effective to melt and devitrify said solder glass, and wherein the step of supporting said mask-receiving surface and said faceplate inner surface spaced apart by a predetermined Q-height include allowing said faceplate to sink through said melted solder glass onto said support structure to said predetermined Q-height where it is affixed permanently to said mask-support structure when said solder glass devitrifies.

4. A process for prefabricating a mask support structure and installing it in a tension mask color cathode ray tube having a faceplate with a centrally located screening area, the process comprising:

providing a unitary mask support structure for affixation on opposed sides of said screening area, said structure having a base surface for attachment to said faceplate, and on an opposed side, a mask-receiving surface;

laying on said base a bead of devitrifying solder glass;

heating said base and said solder glass to a melting temperature below a solder glass devitrifying temperature;

cooling said structure to solidify and shrink said solder glass;

removing material from said solidified solder glass to provide a structure with a uniform height approximately equal to or greater than a predetermined Q-height;

locating said structure on said faceplate on opposed sides of said screening area and heating said faceplate to a solder glass devitrifying temperature;

causing said structure to sink into said solder glass and toward said faceplate such that said mask-receiving surface is stopped at a predetermined Q-height from said faceplate inner surface; and, cooling said faceplate to affix said structure to said faceplate.

5. The process according to claim 4 including the step of depositing a screen on said screening area.

6. The process according to claim 4 including the step of tensing a foil shadow mask in registration with said screen and securing it to said support structure.

7. The process according to claim 4 including the step of depositing a screen on said screening area before installing said support structure.

* * * * *